US007407319B2

(12) United States Patent
Fasoli et al.

(10) Patent No.: US 7,407,319 B2
(45) Date of Patent: Aug. 5, 2008

(54) STORAGE, HOMOGENISATION AND DOSING SYSTEM

(75) Inventors: Gianpaolo Fasoli, Milan (IT); Mauro Carraro, Cassano Magnago (IT); Mauro Fassi, Gudo Visconti (IT); Flavio Crestetto, Milan (IT)

(73) Assignee: CS Automazione S.r.l., Milan (IT)

( * ) Notice: Subject to any disclaimer, the term of this patent is extended or adjusted under 35 U.S.C. 154(b) by 506 days.

(21) Appl. No.: 11/104,302

(22) Filed: Apr. 12, 2005

(65) Prior Publication Data

US 2005/0243645 A1 Nov. 3, 2005

(30) Foreign Application Priority Data

Apr. 15, 2004 (IT) ..... MI2004A0743

(51) Int. Cl.
*B01F 11/00* (2006.01)

(52) U.S. Cl. ..... 366/192; 366/210; 366/276; 210/208

(58) Field of Classification Search ..... 366/198, 366/203, 202, 192, 210, 276, 218, 214, 137, 366/139, 240, 213; 422/99, 102
See application file for complete search history.

(56) References Cited

U.S. PATENT DOCUMENTS 5,054,933 A * 10/1991 Derksen et al. ..... 366/138
5,167,928 A * 12/1992 Kelly et al. ..... 422/99
5,496,110 A * 3/1996 Geier et al. ..... 366/214
5,647,491 A * 7/1997 Foster et al. ..... 211/113
6,517,783 B2 * 2/2003 Horner et al. ..... 422/102
7,018,587 B2 * 3/2006 Heath et al. ..... 422/63
2003/0235108 A1 * 12/2003 Walker ..... 366/143

FOREIGN PATENT DOCUMENTS

| | | | |
|---|---|---|---|
| JP | 2-194885 | * | 8/1990 |
| JP | 02-194885 | | 8/1990 |
| JP | 03-118892 | | 5/1991 |
| JP | 3-118892 | * | 5/1991 |
| JP | 2003-088471 | | 3/2003 |
| JP | 2003-88471 | * | 3/2003 |
| WO | WO 01/28615 | | 4/2001 |

OTHER PUBLICATIONS

EPO Search Report of EP 05 10 2863 dated Jul. 19, 2005, 3 pages.

* cited by examiner

*Primary Examiner*—Tony G Soohoo
(74) *Attorney, Agent, or Firm*—James V. Costigan; Hedman & Costigan, P.C.

(57) ABSTRACT

Storage, homogenisation and dosing system of substances able to precipitate or aggregate comprising at least one tank (20) for storage and a valve (40) for dosing. The at least one tank (20) comprises a tubular portion (21), a bottom (22) and a cover (23).

The at least one valve (40) is housed near to the bottom (22) of the at least one tank (20) and the system also comprises oscillating support means for allowing a good homogenisation of the substances contained in the at least one tank (20).

8 Claims, 6 Drawing Sheets

STORAGE, HOMOGENISATION AND DOSING SYSTEM

TITLE OF THE INVENTION

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

BACKGROUND OF THE INVENTION

1) Field of the Invention

The present invention refers to a storage, homogenisation and dosing system, able to be used for substances that can precipitate or aggregate, such as in particular dying substances in liquid solution or solid.

2) Description of Related Art

The dying substances dosed individually in suitable proportions combine to prepare final dyes, which are then used in many fields of application.

The dying substances comprise organic or inorganic pigments, which can be used directly in solid form or else can be dispersed, in water or in other solvents, before use.

In the case of dying substances used in liquid form, these are previously stored in tanks that, through a hydraulic circuit, feed a system for dosing them. In automatic dosing of dying substances in whatever field of application, the end dying result is heavily influenced by the concentration of the raw materials used.

Therefore, the precision of the weight or volume measurements is obviously of fundamental importance for correct dosing of the dying substances, but, it is equally important to keep as perfect as possible homogeneity of the dying substances themselves.

In the case of dying substances mixed with one or more solvents or vehicles, due to phenomena of stratification and sedimentation, the solid particles, being heavier than the vehicle than the vehicle in which they are suspended, are bound by the force of gravity to sediment towards the lowest point of the plant, i.e. typically towards the bottom of the tank and along the vertical portions of the supply pipes of the product to the dosing system, up to the inside of the dosing valves.

Therefore, in the absence of suitable provisions, the lowest parts of the plant tend to build up more concentrated raw materials with respect to the upper areas.

In the best-case scenario, this leads to the manipulation, perhaps extremely precise, of portions of dying substances having a concentration that is variable in time.

At the start of the process a sufficiently homogeneous dying substance is picked up, whereas, as time passes and as phenomena of sedimentation occur, a dying substance richer in pigment (which have accumulated in the lower areas) is firstly picked up and then a dying substance impoverished by the same phenomenon is picked up.

The consequence is that, with an equal amount of dosed dying substance, the dying power, and therefore the tonalities resulting from their mixtures, are subject to variations out of all control.

In the worst-case scenario, the size of the phenomenon and the nature of the sedimented dying substance can cause the system to become blocked, as well as serious and irreversible damage to the plant.

To take into account this specific aspect, the solutions containing dying substances with solvents are added to with suitable surface-active chemical products, known as dispersants or suspending agents, which have a more or less strong stabilisation effect of the suspensions.

In order to further improve the situation, the viscosity of the dying materials tends to be increased, within the limits allowed by the subsequent use steps.

In both cases the problem is not solved in a radical and long-lasting manner, for which reason the builders of plants find themselves having to provide for a situation that is neither controlled nor standardisable.

To do this homogenisation systems are normally used based upon the use of agitators (to avoid phenomena of sedimentation inside the storage tanks) and of pumps and recycling circuits that are as long as possible (to avoid the phenomenon that also occurs inside the tubes and valves) and as powerful as possible (to avoid the load losses generated by the increase in viscosity of the raw materials and by the extension of the hydraulic delivery circuits for supply and return to the storage tank).

Some systems are equipped with slow anchor agitators at the moment placed in movement through a motor reducer. These systems allow the movement of the suspension inside the storage tank of the raw material.

A disadvantage is that their use is only possible in the case of almost continuous use, and therefore consequently involves substantial energy costs.

Moreover, these systems cannot be used in the case of very long feeding circuits.

Other systems are equipped with turboemulsifiers for highly viscous products that allow a substantial mass of highly viscous product to be used.

A disadvantage of these systems is that some particularly delicate dispersions can be irreversibly damaged by an excessive mechanical action.

Moreover, these systems also cannot be applied in the case of very long feeding circuits and in the case of non-continuous use. Other systems are equipped with complex hydraulic circuits with delivery and return lines and timed recycling pumps.

These systems allow optimal homogenisation inside the pipes and, with a series of provisions, also inside the storage tanks and the dosing valves.

A disadvantage of these systems is that they require greater costs, both in terms of energy needs, and in terms of time for the maintenance of the elements that make up the hydraulic circuit.

A disadvantage of the described systems is that they involve a substantial worsening of the costs represented, for example, by a greater value of the investment in the plant for double hydraulic circuits and/or for the assembly of the agitators.

Another disadvantage of all these systems is that they are complicated, given the increase in the number of dynamic components, such as pumps, agitators and integral recycling valves.

Another disadvantage is that the dynamic components, being subject to wear, require periodic maintenance, which is burdensome in terms of time and costs.

A further disadvantage of these systems is that they involve a considerable increase in the energy needs necessary for the operation of the plant.

Also in the case of dying substances or in any case reactants used directly in the solid form there can be problems of blocking of the system and damage to the plant caused by phenomena of aggregation of the solid particles in agglomerations, both inside the tanks and in other parts of the plant.

For this reason the tanks foresee kinematisms inside the tanks themselves capable of breaking the aggregations to keep the material finely dispersed.

BRIEF SUMMARY OF THE INVENTION

The purpose of the present invention is that of making a storage, homogenisation and dosing system that overcomes the drawbacks of known systems.

Another purpose is that of making a storage, homogenisation and dosing system for substances that can precipitate and/or aggregate, which is simple and cost-effective.

Yet another purpose is that of being able to have a storage, homogenisation and dosing system that can be used both for dying substances dispersed in a solvent and for solid dying substances.

These purposes according to the present invention are accomplished by making a storage, homogenisation and dosing system as outlined in claim 1.

Further characteristics of the invention are highlighted by the subsequent claims.

BRIEF DESCRIPTION OF THE SEVERAL VIEWS OF THE DRAWINGS

The characteristics and advantages of a storage, homogenisation and dosing system according to the present invention shall become clearer from the following description, given as an example and not for limiting purposes, referring to the attached schematic drawings, in which.

DETAILED DESCRIPTION OF THE INVENTION

Figure 1:
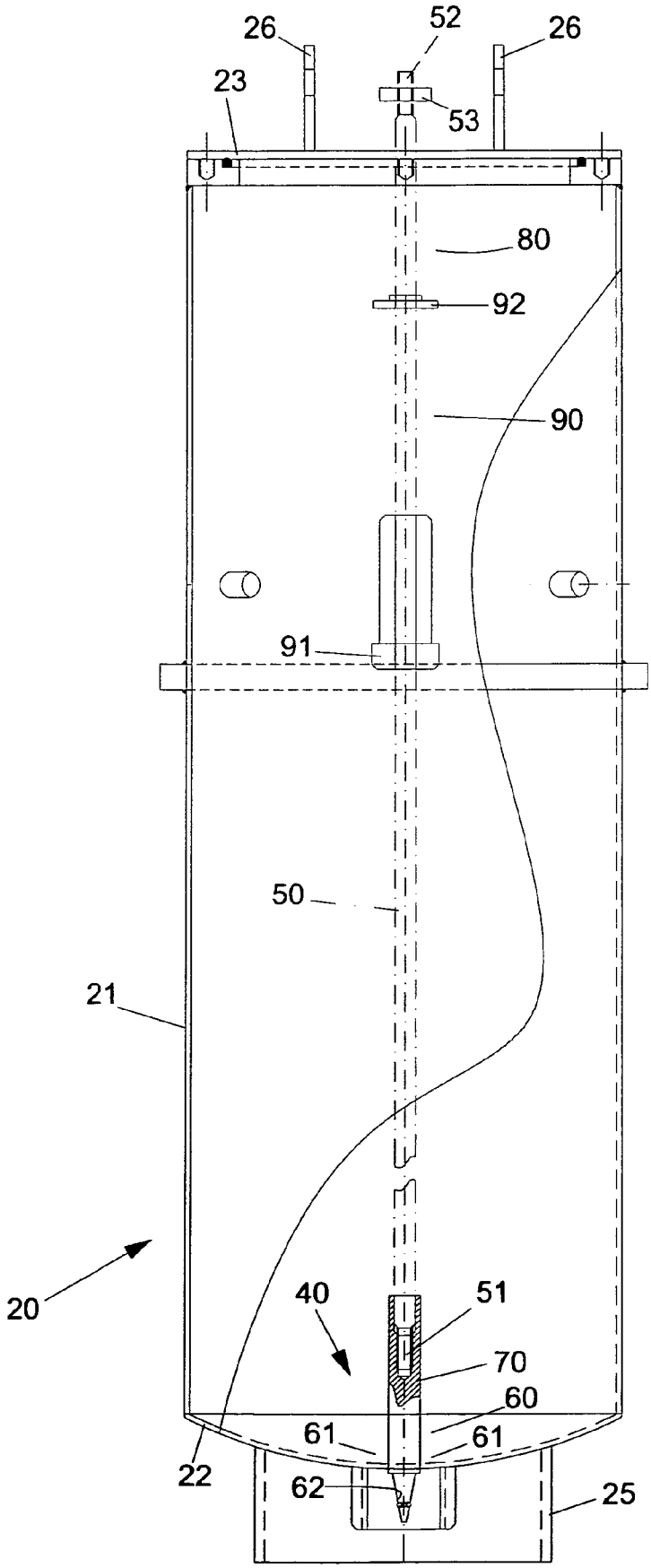
FIG. 1 is an elevation partial section view that shows a preferred embodiment of a tank of a storage, homogenisation and dosing system according to the present invention.
Figure 2:
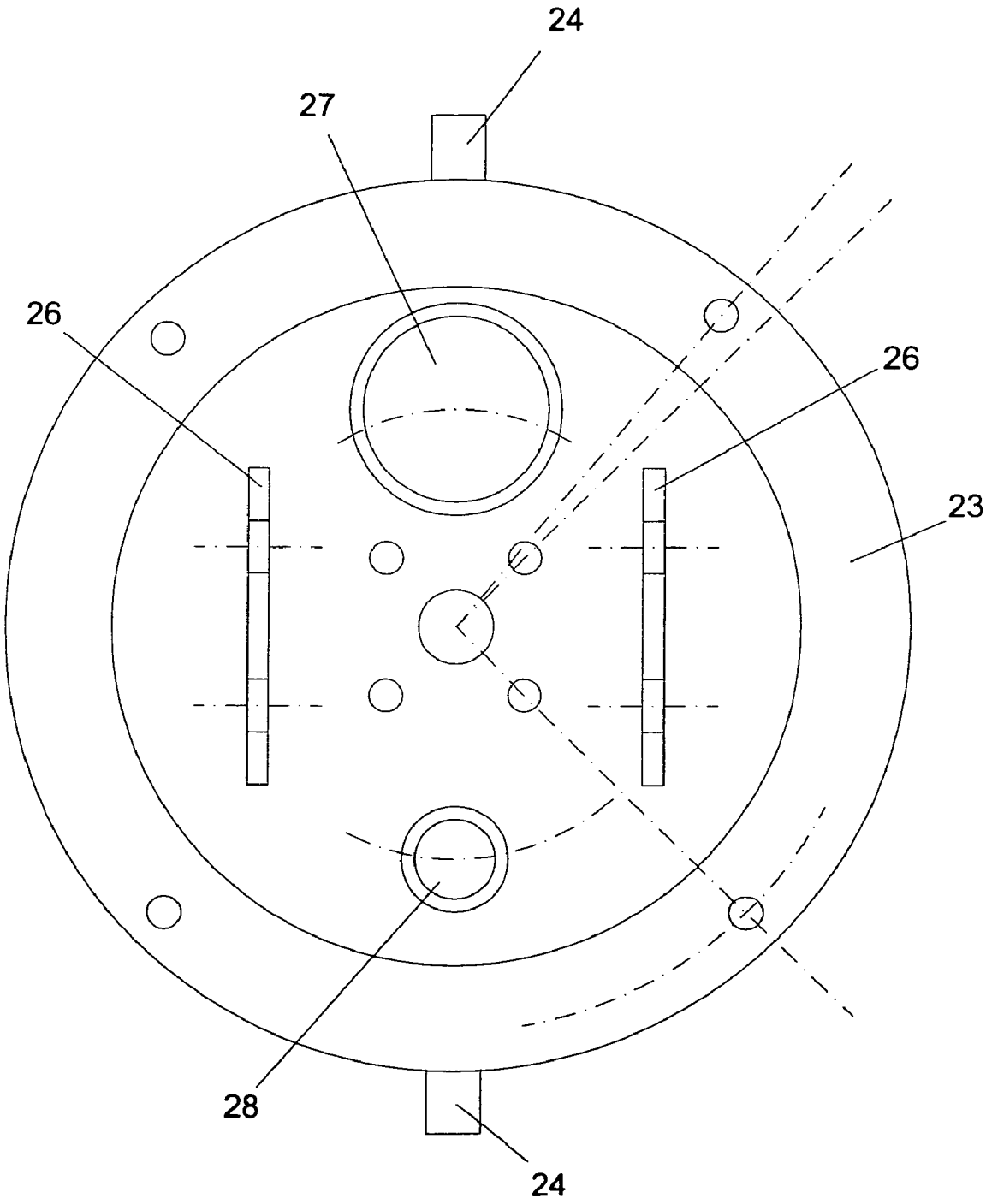
FIG. 2 is a top view of the storage tank of FIG. 1.
Figure 3:
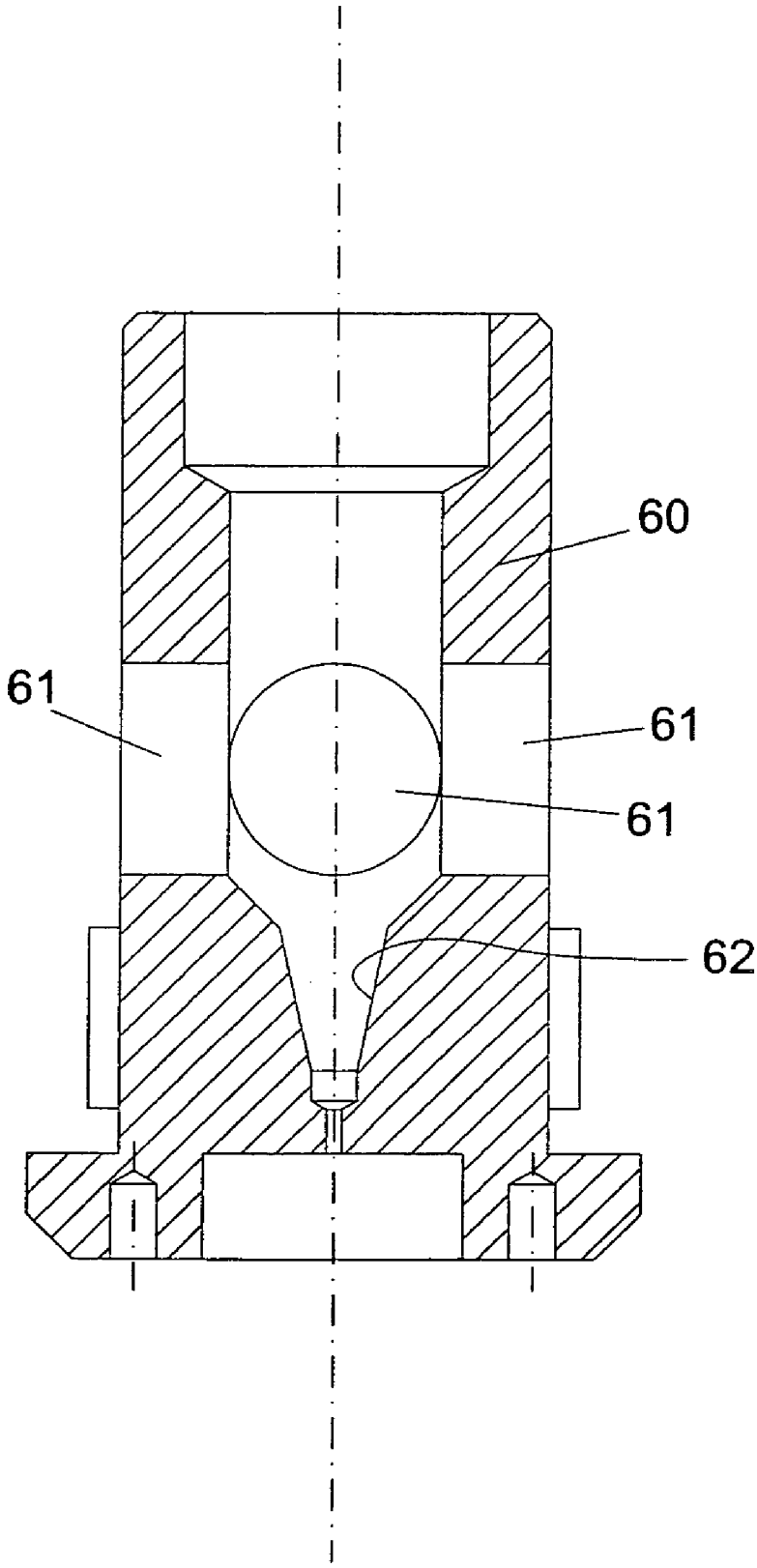
FIG. 3 is an elevation sectional view of a detail of FIG. 1.
Figure 4:
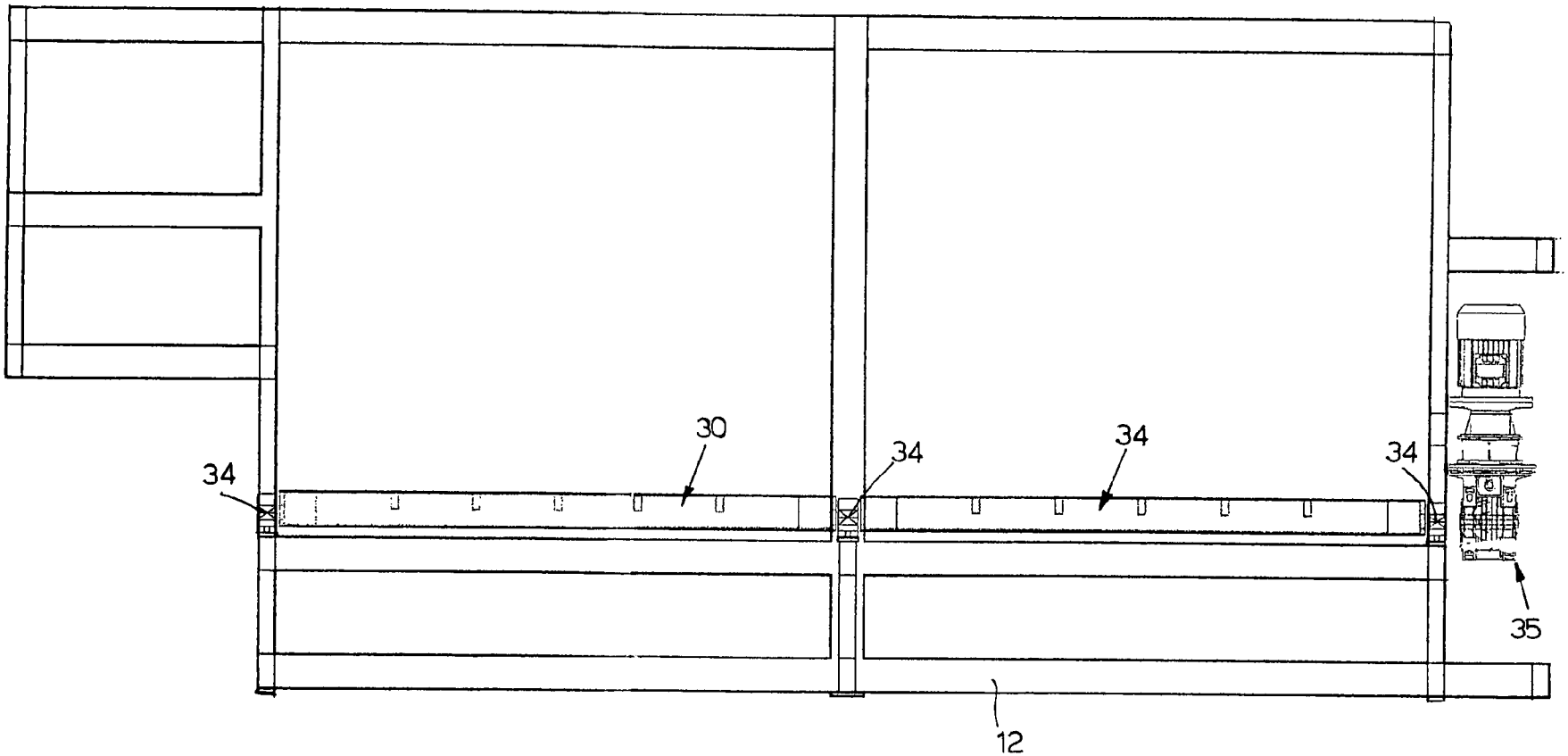
FIG. 4 is an elevation view of a preferred embodiment of oscillating support means of a storage, homogenisation and dosing system according to the present invention.
Figure 5:
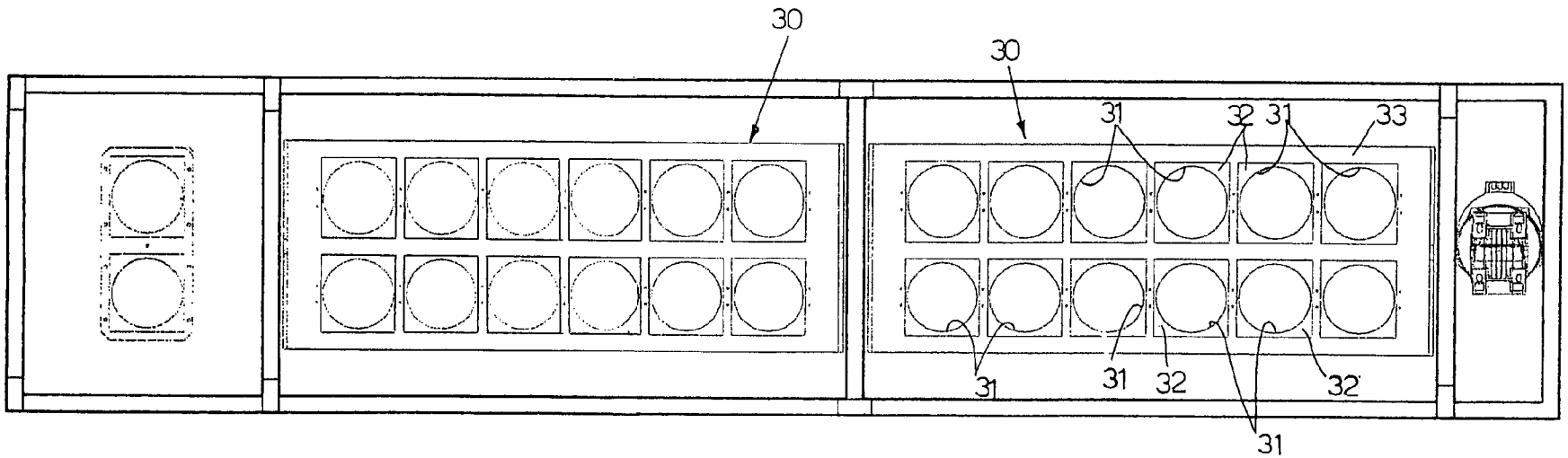
FIG. 5 is a top view of the oscillating support means of FIG. 4.
Figure 6:
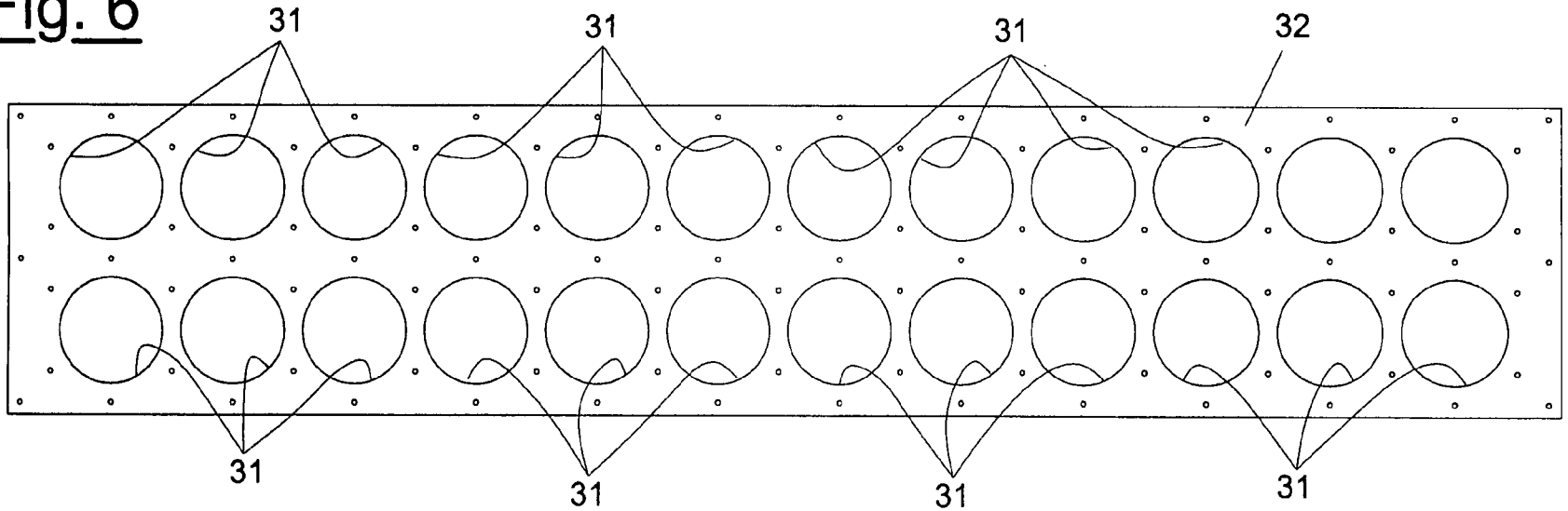
FIG. 6 is a top view of a detail of FIG. 5.
Figure 7:
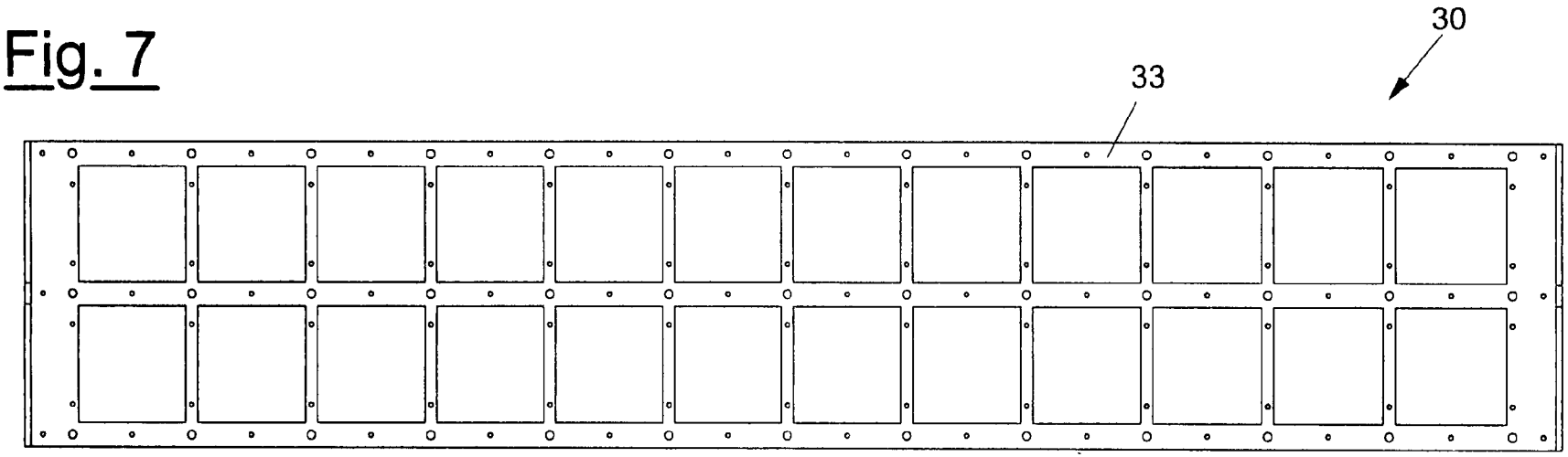
FIG. 7 is a top view of a detail of FIG. 5.

With reference to the figures, a storage, homogenisation and dosing system is shown, comprising at least one storage tank 20, at least one dosing valve 40 and oscillating support means.

The tank has a tubular portion 21 connected to a bottom 22 and a cover 23.

Outside the tubular portion 21 there is preferably fixed at least one support element 24, which can be an outer ring or else can be a plurality of projecting portions welded or in any case fixed to the tubular portion 21.

The at least one tank 20 also comprises at least two gripping elements 26 fixed to the cover 23 for moving the at least one tank 20 itself, for example through a manipulator (not shown in the figures).

The at least one tank 20 preferably also comprises a support portion 25 connected to the bottom 22.

On the cover 23 there are also housed a cap 27 for injecting the substances to be stored inside the at least one tank 20, and a non-return valve 28 for the injection or the outlet of air in order to best dose the dying substances.

The at least one tank 20 comprises a sealing tube 80 that is fixed to the cover 23 of the at least one tank 20 for example through screws.

The at least one tank 20 also comprises a shaft 50 inserted inside the at least one tank 20 through the sealing tube 80.

The shaft 50 has a first end 51 and a second end 52 that projects outside the cover 23 and on which a hooking ring 53 is fixed.

The first end 51, on the other hand, is inserted in a shutter 70 of the dosing valve 40, so as to allow the actuation of the valve 40 itself.

The at least one tank 20 also comprises elastic means 90, 91, 92 that act on the shaft 50 to keep the valve 40 closed.

The elastic means comprise a spring 90 fitted onto the shaft 50, a seat 91 for the spring 90, integral with the shaft 50 and a lipped sealing ring 92 applied to the sealing tube 80.

The spring 90 is fitted onto a portion of the shaft 50 situated between the seat 91 and the lipped sealing disc 92.

The dosing valve 40 is preferably housed near to the bottom 22 of the at least one tank 20.

In this way it is possible to avoid the need for hydraulic supply circuits of the dying substances to be dosed.

Preferably, to dose liquids, the valve 40, which is normally closed, comprises the shutter 70, a body 60 equipped with a central seat 62 for said shutter 70 and comprising a plurality of side openings 61 communicating through the central seat 62.

This communicates with the outside of the at least one tank 20 and, when open, allows the substances contained in the at least one tank 20 to be poured into an outer container.

The oscillating support means comprise at least one table 30 equipped with at least one seat 31 for the insertion of said at least one tank 20.

The at least one table 30 can be in a single piece, or else for constructive practicality it can comprise a plate 32 sandwiched between at least two rigidifying plates 33, having just a structural function, which are screwed or in any case fixed to the plate 32 so as to have a good rigidity of the at least one table itself. The at least one seat 31 can thus be formed directly on the at least one table 30, or else in the plate 32 thereof.

The rotating table 30 is firmly connected to a fixed structure 12 or frame of the storage, homogenisation and dosing system 10.

Moreover, the table 30 is able to rotate with respect to a longitudinal axis thereof to consequently make the at least one tank 20 oscillate or vibrate, since it is hinged to the fixed structure 12, preferably through hinges 34.

In this way it is possible to homogenise the substances contained inside the at least one tank 20, be they solid or liquid.

To do this the rotating and/or vibrating table 30 is connected and actuated through a motor device 35 commanded by a processing unit (not shown in the figures).

The actuation of the rotating table 30 is possible both continuously and discontinuously, so as to allow continuous use of the substances contained inside the at least one tank, be they liquid or solid, be they pure substances or mixtures, still able to precipitate or aggregate.

In this way it is possible to integrate the storage and dosing functions in a single member (the at least one tank 20).

Indeed, it is possible to raise the at least one tank 20 from the at least one rotating table 30 through a manipulator (not shown in the figures), which can grip the at least two gripping elements 26 of the at least one tank 20, and then transport and position the at least one tank 20 itself in a dosing station.

In such a station, through a suitable device or dosing system, the substances contained inside the at least one tank 20 can be drawn out, by actuating the dosing valve 40.

The dosing device is capable of lifting the hooking ring 53, overcoming the reaction force of the spring 90, so as to open the dosing valve 40.

By injecting air through the non-return valve 28 it is possible to pour a well defined amount, by weight or by volume, of the substances contained inside the at least one tank 20 in a controlled manner into a container positioned below the dosing valve 40.

The storage, homogenisation and dosing system lends itself in particular to be used for dying substances, in solid or else liquid form.

However, it is clear that inside the at least one tank 20 a liquid solution or a solid substance that can have problems of sedimentation and/or aggregation can be stored.

Advantageously, a system according to the present invention lacks supply circuits, both for delivery and return, and therefore avoids the problems of the prior art relative to the precipitation inside the circuits themselves.

It has thus been seen that a storage, homogenisation and dosing system according to the present invention achieves the purposes outlined previously.

The storage, homogenisation and dosing system of the present invention thus conceived is susceptible to numerous modifications and variants, which are all covered by the same inventive concept.

Moreover, in practice, the materials used, as well as their sizes and the components, can be whatever according to the technical requirements.

The invention claimed is:

1. Storage, homogenization and dosing system of substances able to precipitate or aggregate comprising at least one tank (20) for storage and at least one valve (40) for dosing, said at least one tank (20) comprising a tubular portion (21), a bottom (22) and a cover (23), characterised in that said at least one valve (40) is housed near to the bottom (22) of said at least one tank (20) and in that said system comprises an oscillating support means for said at least one tank (20) for allowing homogenization of the substances contained therein; and, in that said at least one tank (20) comprises at least one support element (24) fixed to the tubular portion (21) thereof; and, a support portion (25) connected to the bottom (22), at least two gripping elements (26) fixed to the cover (23), and in that said oscillating support means comprise a motor device (35) and at least one rotating table (30) firmly connected to a fixed structure (12) of said system, said table (30) being equipped with at least one seat (31) for said at least one tank (20), and in that said at least one table (30) comprises a plate (32) in which the at least one seat (31) is formed and at least two rigidifying plates (33) screwed to the plate (32), and in that said at least one table (30) is hinged to the fixed structure (12) through hinges (34) and, in that said at least one tank (20) comprises a non-return valve (28) housed in the cover (23) and, in that said valve (40) comprises a shutter (70), a body (60) comprising a central seat (62) for said shutter (70) and a plurality of side openings (61) communicating with said central seat (62).

2. System according to claim 1, characterized in that said at least one tank (20) comprises a sealing tube (80) that is fixed to the cover (23) of the at least one tank (20) itself.

3. System according to claim 1, characterised in that said at least one tank (20) comprises a shaft (50) inserted inside the at least one tank (20) through said scaling tube (80).

4. System according to claim 3, characterised in that said shaft (50) comprises a first end (51) and a second end (52), said first end (51) being inserted in said shutter (70) of the dosing valve (40) to allow its actuation.

5. System according to claim 4, characterised in that said second end (52) of the shaft (50) projects outside the cover (23) and characterised in that said at least one tank (20) comprises a booking ring (53) integral with said second end (52) of the shaft (50).

6. System according to any one of claims 3 to 5, characterised in that said at least one tank (20) comprises elastic means (90, 91, 92) that act on the shaft (50) to keep the valve (40) closed.

7. System according to claim 4, characterised in that said elastic means comprise a spring (90) fitted onto the shaft (50), a seat (91) for the spring (90), integral with the shaft (50) and a lipped scaling ring (92) applied to the sealing tube (80).

8. System according to claim 6, characterised in that said spring (90) is fitted on a portion of the shaft (50) situated between the seat (91) and the lipped sealing disc (92).

* * * * *